United States Patent [19]

Widen

[11] 4,453,432

[45] Jun. 12, 1984

[54] METHOD OF MANUFACTURING A KEY FOR A CYLINDRICAL LOCK

[75] Inventor: Bo G. Widen, Torshälla, Sweden

[73] Assignee: GKN Stenman, AB, Eskiltuna, Sweden

[21] Appl. No.: 404,324

[22] Filed: Aug. 2, 1982

Related U.S. Application Data

[62] Division of Ser. No. 165,358, Jul. 2, 1980, Pat. No. 4,356,713.

[30] Foreign Application Priority Data

Jul. 10, 1979 [SE] Sweden ..... 7906023

[51] Int. Cl.[3] ..... B21K 13/00; E05B 19/02

[52] U.S. Cl. ..... 76/110

[58] Field of Search ..... 76/110, 101 R

[56] References Cited

U.S. PATENT DOCUMENTS

| | | | |
|---|---|---|---|
| 1,905,177 | 4/1933 | Kirkwood . | |
| 2,035,181 | 3/1936 | Molinare | 70/407 |
| 2,157,142 | 5/1939 | Olson | 70/406 |
| 2,426,104 | 8/1947 | Johnstone | 70/421 |
| 2,660,876 | 5/1949 | Spain . | |
| 3,303,677 | 2/1966 | Bauer . | |
| 3,388,619 | 6/1968 | Schreiber et al. | 76/110 |
| 3,541,819 | 11/1970 | Kerr . | |
| 3,722,240 | 3/1973 | Spain | 80/364 A |
| 3,742,744 | 7/1973 | Lumme . | |
| 4,100,778 | 7/1978 | Gretler . | |
| 4,164,857 | 8/1979 | Genakis . | |
| 4,222,252 | 9/1980 | Tietz | 70/364 A |

FOREIGN PATENT DOCUMENTS

| | | |
|---|---|---|
| 2378927 | 8/1978 | France . |
| 1543940 | 4/1979 | United Kingdom . |
| 1557246 | 12/1979 | United Kingdom . |
| 1557245 | 12/1979 | United Kingdom . |

*Primary Examiner*—Roscoe V. Parker

*Attorney, Agent, or Firm*—Pennie & Edmonds

[57] ABSTRACT

The combination of a cylinder lock and key, wherein the key comprises a blade with a longitudinally extending edge portion at one side of the blade provided with a coded surface for engaging the ends of a row of locking pins in the cylinder core of the lock. The coded surface has code portions which engage a segment of the end of each pin spaced from the center thereof, and transition portions for guiding the pins between adjacent code portions and which are of concavely curved cross-sectional shape to provide for arcuate engagement with the pins, the code portions and transition portions of the coded surface being open to the side of the key blade and spaced from the other side thereof. The coded surface is produced by moving a rotary cutting tool relative to the key blank with substantially the same movement as the pins undergo relative to the key as the latter is inserted into and removed from the cylinder of the lock. There may be more than one row of locking pins, which may co-operate with side bars in the cylinder.

1 Claim, 16 Drawing Figures

METHOD OF MANUFACTURING A KEY FOR A CYLINDRICAL LOCK

This is a division, of application Ser. No. 165,358 filed Jul. 2, 1980 and now U.S. Pat. No. 4,356,713.

BACKGROUND TO THE INVENTION

1. Field of the invention

This invention relates to a cylinder lock and key therefore, the lock comprising a housing, a cylinder core mounted for rotation in the housing, a slot extending into the cylinder core, parallel to the rotational axis thereof, for receiving the key, and a row of locking pins of circular cross-section guided in bores in the cylinder core, which bores intersect over parts of their length with said slot, the pins being movable against spring means when a key is inserted into the slot. The invention also relates to the key for such a combination, and a method of manufacturing the key.

2. Description of prior art

There have been many proposals hitherto for cylinder locks incorporating different modes of engagement between the locking pins and the key. For example, British patent specification No. 1543940 describes a lock in which the cylinder core has two rows of parallel pins which have pointed ends, the pins in each row engaging a respective one of two parallel coded parts on the edge of the key.

The key for such a lock, however, must be comparatively thick in order for it to be able to co-operate with the pointed ends of the locking pins. Thus, the width of each of the coded parts of the key must be at least half the thickness of the pins. This represents a disadvantage if it is desired to reduce the diameter of the cylinder core to a minimum value. A further disadvantage is that the points of the locking pins, and the coded surfaces on the key, are subject to wear, thereby shortening the useful life of the lock.

Published French patent application No. 2378929 discloses a key which has along its edges, two rows of coded recesses. However, such a key is intended for use with a lock employing flat tumblers, rather than locking pins as the present invention is concerned with.

British patent specification No. 1,557,245 discloses a cylinder lock and key combination with a flat key which has codes on its side for engagement with pins disposed at 90° and 45° to the general plane of the key. However, there is no provision for guiding the pins between their engagement with operative parts of the codes, and hence the pins and key are subject to considerable wear in service.

It is the object of the present invention to provide a cylinder lock and key in which the aforementioned and other disadvantages of known locks are overcome or reduced.

SUMMARY OF THE INVENTION

According to the present invention, we provide the combination of a cylinder lock and a key therefor, comprising:

(a) a housing;

(b) a cylinder core mounted for rotation in said housing;

(c) a slot extending into the cylinder parallel to the rotational axis thereof for receiving the key;

(d) a row of locking pins of circular cross section guided in bores in said cylinder core, which bores intersect over parts of their lengths with said slot, the pins being movable against spring means when a key is inserted into said slot and the center lines of the pins lying in a plane;

(e) said key comprising a blade having an edge a longitudinally extending portion of which at one side of the blade affords a coded surface of engaging end portions of the pins, said coded surface including, (f) code portions for holding respective pins in predetermined positions by engaging only a segment of said end portion of each pin spaced from the pin center line when the key is in an operative position in said slot thus to release the cylinder core for rotation, and (g) transition portions which extend lengthwise between adjacent code portions and which engage and guide the pins substantially for the whole of the distance between adjacent code portions as the key is moved into and out of its operative position, each transition portion having a concavely curved cross-sectional shape transverse to its length and which is constant over the whole length of the transition portion so that the portion has an arcuate region of engagement with a pin as the latter is guided by the transition portion between adjacent code portions, (h) the code portions and transition portions being open to said one side of the blade and being spaced from the other side of the blade so that there is a thickness of material between said portions and said other side.

Because of the arcuate region of engagement between the transition portions of the coded surface of the key and the locking pins, a relatively great contact area between pin and key is acheived without the coded surface of the key (and thus the key itself) being required to have a great width. Wear on the key and pins is thus minimised for a given thickness of key. A further advantage arising from the arcuate engagement between the pins and the transition portions of the coded surface, and the segmental engagement between the pins and code portions of the coded surface, is that the pins are subjected to a torque which causes them to be rotated when the key is inserted into and removed from the lock. Fresh surfaces on the pins thus constantly come into engagement with the coded surface of the key, further reducing wear.

Because the coded surface is provided on an edge at one side of the key blade, the height of the coded surface can be small relative to the overall height of the blade of the key. The coded surface can thus co-operate with locking pins which need not be centrally disposed in the cylinder core, but which may be offset and yet still completely received in the cylinder core. Reduction in the diameter of the cylinder can thus be acheived.

Locking pins of this kind, offset in the cylinder core, can convienently co-operate with a side bar, accommodated in a recess extending axially in a peripheral part of the cylinder core and being spring biassed outwardly into engagement with a recess in the housing, the recess in the housing being shaped to retract the side bar into the cylinder upon turning of the latter provided that a number of lugs on the side bar can engage in waisted portions in the locking pins to permit the retraction.

A further row of locking pins may also be provided in the cylinder core, so that a central longitudinal plane of the slot lies symmetrically between the planes containing the center lines of rows of locking pins, the further row of locking pins being engageable with a coded surface provided on a longitudinally extending edge portion of the blade of the key at the other side thereof from the first said coded surface. The code portions and transition portions of the second coded surface would be open to the other side of the blade from the first coded surface, and there would be a thickness of material between the two edge portions and there coded surfaces. The edge of the blade between the coded surfaces at the one and other sides thereof may then be provided with yet another code, to control further locking pins.

By this means, large numbers of combination possibilities can be achieved in a lock of relatively small dimensions.

The plane containing the center lines of at least one row of locking pins may make an included angle of not more than about 30° to 35° with a central longitudinal plane of the slot.

The end portions of the locking pins may be substantially flat with a rounded or chamfered edge.

In order to achieve the aforementioned arcuate engagement between the locking pins and transition portions of the coded surface the transition portions may geometrically be described as parts of a surface described by a point rotating at a fixed distance about and moving parallel to an axis which is parallel to the center lines of the pins, while said axis moves relative to the blade longitudianlly thereof while remaining at constant distance from and orientation relative to the blade. Preferably the point rotates about said axis at a radius substantially equal to the radius of the pins, and said axis lies in a plane containing the pin center lines.

In order to produce a coded surface of this geometrical description, the invention provides a method of manufacturing a key for a cylinder lock, which comprises setting up a key blank having a blade relative to a rotatable cutting tool so that the axis of rotation of the cutting tool lies substantially parallel to the plane of the center lines of the locking pins, and effecting relative displacement between the tool and key blank along the tool's axis of rotation and longitudinally of the blade of the key blank while engaging an edge portion of said blade by said tool, to cut material from the blade to form the coded surface thereon.

The invention also provides a key for the lock and key combination.

BRIEF DESCRIPTION OF DRAWINGS

The invention will now be described by way of example with reference to the accompanying drawings, of which

DESCRIPTION OF PREFERRED EMBODIMENT

Figure 1:
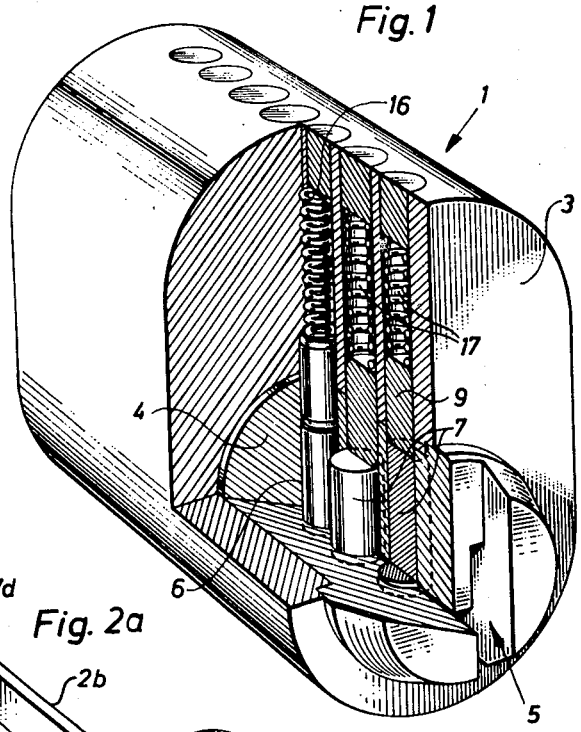
FIG. 1 is a partly cut away view, in perspective, of a cylinder lock according to the invention.
Figure 2B:
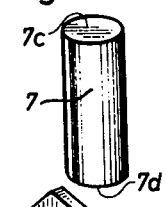
FIGS. 2*a* and 2*b* are perspective views, illustrating a key and a pin respectively, for the lock shown in FIG. 1.
Figure 2A:
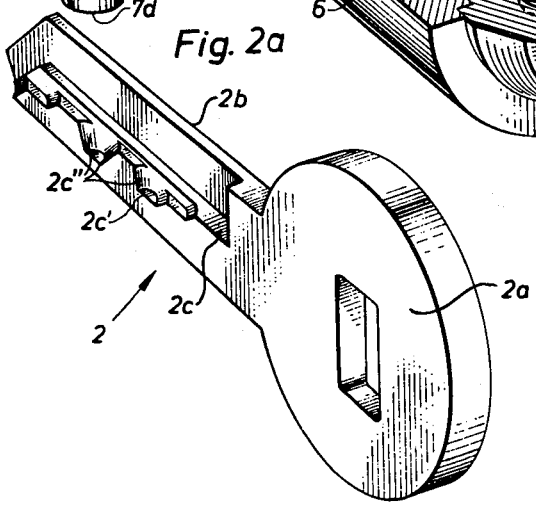
Figure 3:
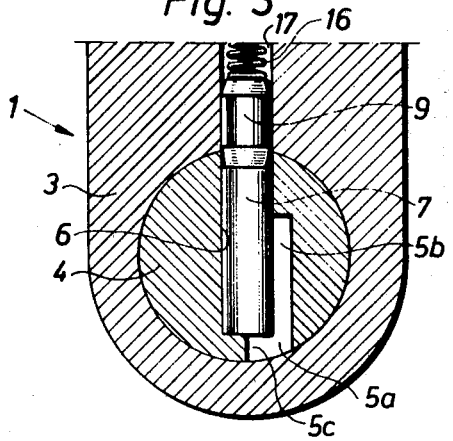
FIG. 3 is a cross-sectional view through the lock shown in FIG. 1.
Figure 4:
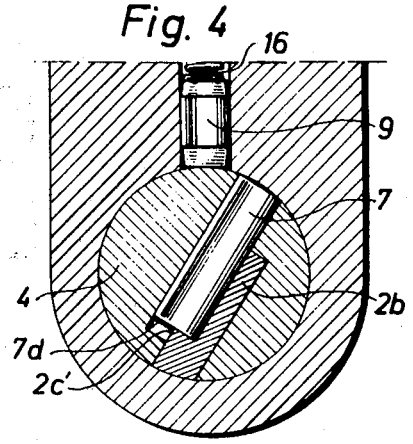
FIG. 4 is a cross-sectional view corresponding to FIG. 3, showing the position of the lock components subsequent to inserting a key into said lock and turning the cylinder core thereof.

Referring firstly to FIGS. 1 to 4, there is illustrated a cylinder lock 1 which comprises a lock housing 3 with a cylinder core 4 received therein for rotation about a central axis of the cylinder. Extending into the cylinder 4 parallel to the rotational axis thereof is a slot 5 for receiving a key 2. The key comprises a head 2*a* by which it can be gripped, a blade 2*b* and a side part 2*c* on the blade. The slot 5 in the cylinder 4 has a part 5*b* which receives the blade of the key, a part 5*c* which receives the side part 2*c* of the key, and a part 5*a* which receives the bottom of the blade and side part of the key.

The cylinder 4 is provided with a row of bores 6 which accommodate locking pins 7 of circular cross-section. Bores 17 are provided in the housing 3 to accommodate a number of upper locking pins 9. These upper locking pins 9 have frusto conical ends, and are biased downwardly by springs 16 which abut plugs in the top of the bores 17 in the housing. The locking pins 7 have planar upper and lower end surfaces 7*c*, 7*d*.

The axes of the pins 6 occupy a plane which is spaced from and parallel to the part 5*b* of the slot which receives the blade of the key. Part only of the lower end surface 7*d* of each pin extends into the part 5*c* of the slot which receives the side part of the key. The side part 2*c* presents a coded surface, open to one side of the blade, which sets the locking pins in respective positions within their bores, the coded surface comprising code portions 2*c*′ which take the form of ledges or plateaux, with which the lower end surfaces of the pins engage when the key is fully inserted into the cylinder core, and inclined transition portions 2*c*″ between the code portions for moving the pins within their bores. As is conventional for cylinder locks, when the correct key is inserted the heights of the code portions 2*c*′ of the key coded surface so relate to the lengths of the locking pins 7 that the upper end surfaces 7*c* of the pins lie substantially flush with the periphery of the cylinder, enabling the cylinder to be rotated.

When the position of a pin is determined by one of the code portions of the coded surface of the key side part, there is flat contact between the key and pin over a segment of the pin's lower end surface 7*d*. The transition portions 2*c*″ of the coded surface have, viewed along such portions, a concavely curved cross-sectional shape so that when a pin is resting on the transition portion there is an arcuate region of contact therebetween. The effect of this is that when the key 2 is inserted into and removed from the slot 5 in the cylinder 4, the pins are readily moved up and down in their respective bores and finally adopt accurately defined positions therein. Further, there is a resistence to wear because there is always a relatively great contact area between the key and pins.

The coded surface of the key geometrically is part of a surface described by a point rotating at a fixed distance about and moving parallel to an axis which lies parallel to the axes of the pins, such axis moving relative to the key blade longitudinally therof while remaining at a constant distance from, and orientation relative to, the blade. The fixed distance at which the point rotates is substantially equal to the radius of the pins, or greater than the pin radius. The best engagement between the pins and key would be achieved if the radius of movement of the point is identical to the pin radius, and the axis moves in a plane which bears the same relationship relative to the key, in terms of distance from the key and relative orientation, as the plane which contains the pin axes.

In other words, the movement of the point describing the coded surface of the key, relative to the key, is substantially the same as the relative movement which occurs between pins and key as the key is inserted into and removed from the cylinder.

In practical terms, the coded surface of the key is produced by a cutter which undergoes the same movement as the pins relative to the key. This is illustrated in FIGS. 5 and 6.

The key is made from a key blank having a blade 2*b* and a side part 2*c*, and the code portions 2*c*′ and transition portions 2*c*″ are formed on the side part by a milling or drilling cutter 25, rotatable about an axis which is oriented relative to the key parallel to the pin axes. Preferably the radius of the tool 25 is the same as the pin radius, and the axis occupies the plane of the pin axes. The tool is then rotated, and relative displacement is effected between the tool and key blank along the tool-3 s axis of rotation and longitudinally of the key. During this operation, the key blank is held in a suitable fixture so that the orientation of the cutting tool and key blank, and the distance of the axis of rotation of the tool from the blade of the key blank, do not change.

Figure 5:
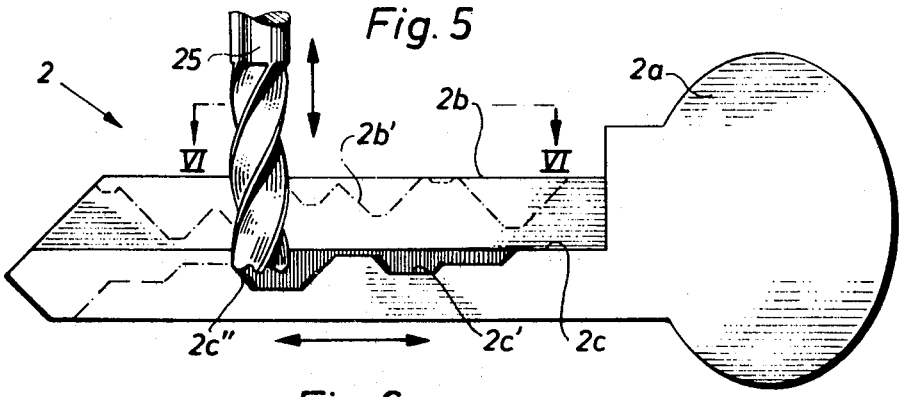
FIG. 5 is a side view illustrating the principle by which a key for a lock of the above figures is manufactured
Figure 6:
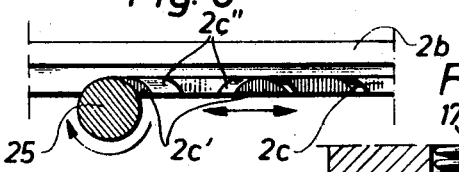
FIG. 6 is a sectional view taken on the line VI—VI in FIG. 5.

FIG. 6 is a view on the line VI—VI of FIG. 5, and also illustrates the relative movement between the key blank and cutting tool.

The blade 2*b* of the key may be provided with an edge code 2*b*′ of conventional type, for operating a conventional set of tumbler pins. This code may be provided before or after the code 2*c*′on the side part of the key. As illustrated in FIG. 5, the code 2*b*′ is different from the code 2*c*′.

Further modifications of the lock are shown in FIGS. 7 to 13.

Figure 7:
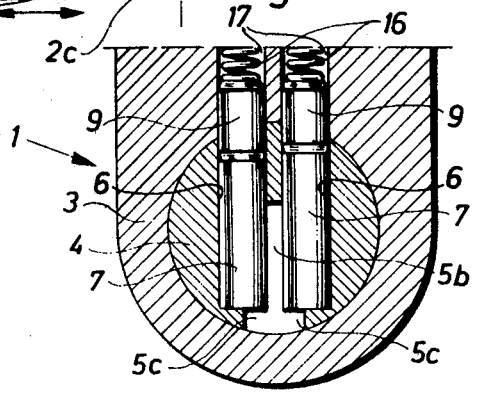
FIG. 7 is a sectional view of a lock according to the invention provided with two rows of locking pins.

In FIG. 7 there is shown a lock with two rows of pins 7 symmetrically disposed in the cylinder 4. Each of the pins 7 co-operates with an upper pin 9 in a bore 17, biassed by a spring 16. The key would have two side parts on opposite sides of its blade, the side parts occupying parts 5*c* of the slot in the lock cylinder. Each side part would have a code surface which is formed, and co-operates with the pins 7, in the same manner as that described above.

Figure 8:
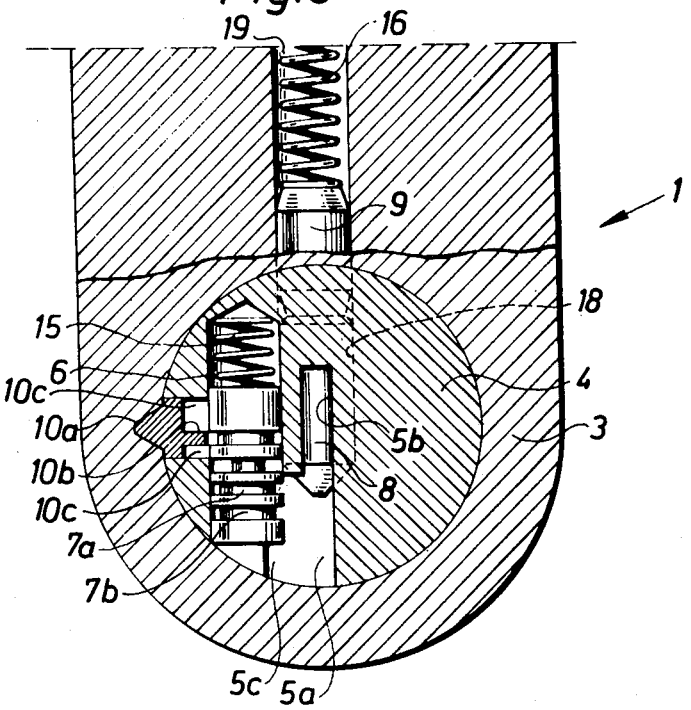
FIG. 8 is a cross-sectional view of a lock according to the invention with a row of pins laterally displaced and co-operating with a side bar extending along the periphery of the cylinder core.
Figure 9:
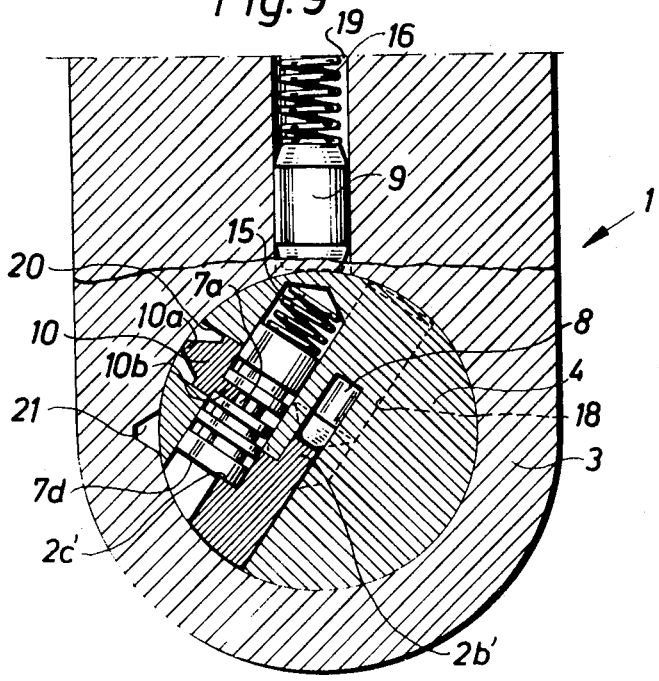
FIG. 9 is a cross-sectional view illustrating the lock according to FIG. 8 subsequent to inserting a key into said lock and turning the cylinder core.

FIGS. 8 and 9 show an embodiment in which the cylinder 4 of the lock has a set of conventional pin tumblers (with upper pins 9 received in secondary bores 19 in the housing, and lower pins 8 in tertiary bores 18 in the cylinder core and biasing springs 16), to be operated by an edge code on the blade of a key. Thus the pins 8 enter the portion 5*b* of the slot in the cylinder which corresponds to the blade of the key. The cylinder also carries pins 7 offset from the axis of the cylinder, and biased by springs 15 to co-operate with a coded side part of the key. The pins 7 each have waisted portions 7*a*, 7*b*, and co-act with a side bar 10 which is accommodated in an elongate recess 20 in the side of the cylinder. The side bar 10 has a V-section outer part 10*a* which engages in a V-section recess in the housing 3.

When the pins 8, 9 have been placed in appropriate operative positions to free the cylinder for rotation, turning of the cylinder by the key effects inward displacement of the side bar 10, provided that the pins 7 are in appropriate positions to permit each of a number of shoulders or lugs 10*b* on the inner side of the side bar to enter a waisted portion 7*a* on each 7. This inwardly displaced position of the side bar is shown in FIG. 9.

All the pins 7 are identical, having at least one waisted portion 7*a* of depth sufficient to receive the lugs 10*b* of the side bar. The lugs 10*b* are positioned at different heights on the side bar so that the pins 7 have to be positioned, by the side part code of the key, differently within their bores to permit retraction of the side bar and thus rotation of the cylinder.

The lugs 10*b* which enter the waisted portions 7*a* of the pins 7 are, viewed parallel to the pin axes, of arcuate shape so that they can engage a substantial part of the peripheral surface of the pins. If an attempt is made to pick or force the lock, the pressure exerted by the side bar against the locking pins if its lugs do not enter the waisted portions will be distributed over a large surface area, rendering picking more difficult and reducing wear.

Between the lugs 10*b* on the side bar 10 are parts 10*c* which engage guide surfaces in the cylinder between the pins 7. These assist in guiding the side bar in its recess during its retraction movement to resist tilting and possible jamming of the side bar.

The waisted portions 7*b* on the pins are shallower than the waisted portions 7*a*. If an attempt is made to pick the lock, these shallower waisted portions can give a false impression that the pin has been moved to the correct position to permit side bar retraction, but do not in fact permit such retraction. This makes picking more difficult. At least one of the pins may have two or more waisted portions 7*a* of adequate depth to permit side bar retraction, to provide a master key facility in known manner.

Figure 10:
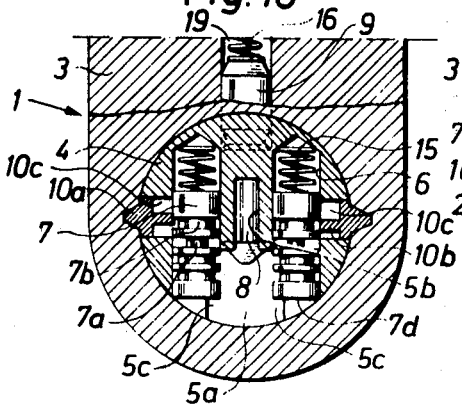
FIGS. 10 and 11 cross-sectional views corresponding to FIGS. 8 and 9 respectively, but having two rows of pins arranged to co-act with a respective side bar.
Figure 11:
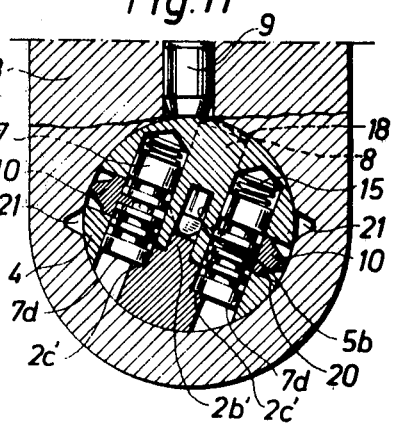

FIGS. 10 and 11 are sectional views corresponding to FIGS. 8 and 9 of a modified embodiment with an additional row of pins 7, co-acting with a side bar as described above and disposed on the opposite side of the cylinder to the first row of the side bar pins. The side parts 2*c* of the key 2 may be provided with different codes 2*c*′. The operation of each side bar, taken individually, is the same as that described above.

Figure 12:
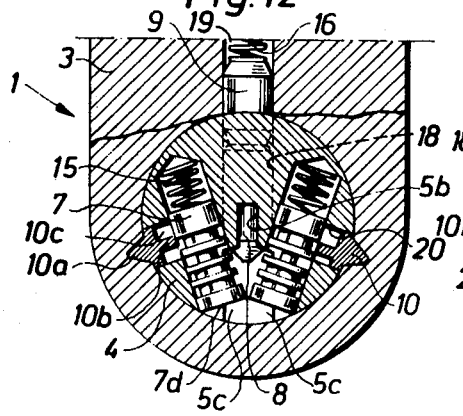
FIGS. 12 and 13 are cross-sectional views corresponding to FIGS. 10 and 11 respectively, having rows of pins which extend at an angle to one another and each of which co-act with a respective side bar.
Figure 13:
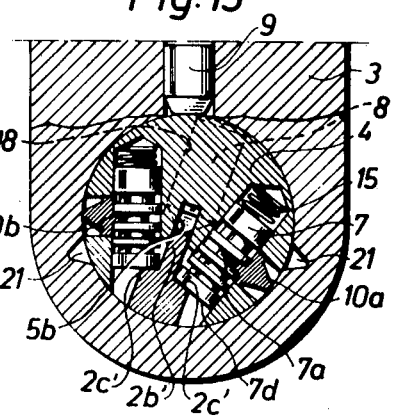

FIGS. 12 and 13 show another modification in which two rows of side bar pins 7 are not disposed parallel to the blade of the key but at an acute angle thereto and to each other. The included angle between the center lines of each row of pins and a central longitudinal plane of the slot is not more than about 30° to 35°. The operation of this embodiment, however, is the same as that described above except that manufacture of the coded surface on the side part of the key would be carried out by using a cutter which has the same orientation as the pins relative to the blade of the key.

Figure 14:
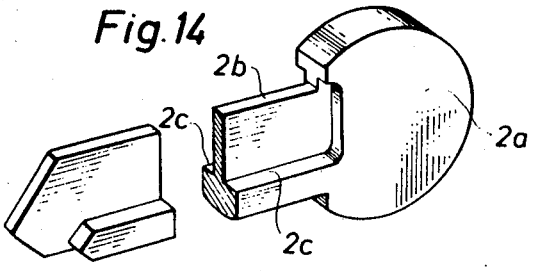
FIGS. 14 and 15 are perspective views of exemplary key blanks for manufacturing keys for a combination according to the invention.
Figure 15:
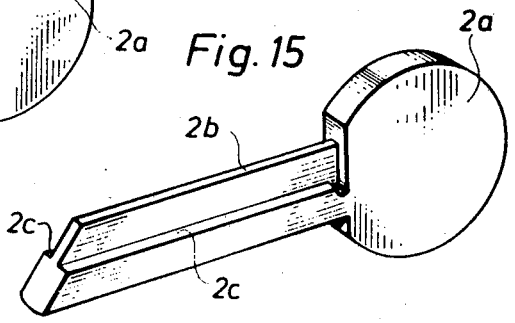

FIGS. 14 and 15 show key blanks suitable for use in manufacturing keys according to the invention. However, other kinds of key blanks could be used; for example the blade can be produced by removal of material from the key when forming the side part thereof or when producing the code on the side part. In all the embodiments illustrated the blade is shown as having a rectangular cross-sectional shape, but this is not necessary and the blade may be curved or provided with longitudinally extending grooves as is generally known.

The pins 7 have been illustrated as having flat lower end surfaces *7d*. This is convenient to manufacture, but the pins may have lower end surfaces which are of other shapes, e.g. domed or frustoconical. In this case, the cutting tool used for forming the code surface on the side part of the key ideally would have the same configuration to its end. However, adequately close engagement between the key and pins might still be possible if a flat ended cutting tool were to be used.

Although it is desirable that the orientation of the cutting tool relative to the key blank should be identical to that of the pins, absolute identity is not essential and some angular deviation can be tolerated without jeopardising the function as described above.

In the illustrated embodiments, the coded surface *2b'* on the blade *2b* lies on a higher level than the code portions *2c'* on the side part of the key. In certain cases, however, the two codes may exhibit parts which merge with one another.

I claim:

1. A method of manufacturing a key for a cylinder lock comprising a housing, a cylinder core mounted for rotation in said housing, a slot extending into the cylinder core parallel to the rotational axis thereof for receiving the key and a row of locking pins of circular cross-section guided in bores in said cylinder core which bores intersect over parts of their lengths with said slot, the pins being movable against spring means when a key is inserted into said slot and the center lines of the pins lying in a plane; comprising setting up a key blank having a blade relative to a rotatable cutting tool so that the axis of rotation of the cutting tool lies substantially parallel to said plane and effecting relative displacement between the tool and key blank along the tool's axis of rotation and longitudinally of the blade of the key blank while engaging an edge portion of said blade by said tool, to cut material from the blade to form a coded surface thereon, said coded surface having code portions for holding respective pins in predetermined positions when the key is in an operative position in said slot and transition portions which extend lengthwise between adjacent code portions to engage and guide the pins substantially for the whole of the distance between adjacent code portions as the key is moved into and out of its operative position, each transition portion having a concavely curved cross-sectional shape transverse to its length and which is constant over the transition portion to provide for an arcuate region of engagement with a pin as the latter is guided thereby.

* * * * *